US007038530B2

(12) United States Patent
Chou

(10) Patent No.: US 7,038,530 B2
(45) Date of Patent: May 2, 2006

(54) REFERENCE VOLTAGE GENERATOR CIRCUIT HAVING TEMPERATURE AND PROCESS VARIATION COMPENSATION AND METHOD OF MANUFACTURING SAME

(75) Inventor: Chung-Cheng Chou, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 44 days.

(21) Appl. No.: 10/833,667

(22) Filed: Apr. 27, 2004

(65) Prior Publication Data

US 2005/0237104 A1 Oct. 27, 2005

(51) Int. Cl.
*G05F 1/10* (2006.01)

(52) U.S. Cl. ..... 327/543; 327/513

(58) Field of Classification Search ..... 323/312, 323/313, 314, 315; 327/512, 513, 534, 535, 327/538, 539, 540, 541, 543
See application file for complete search history.

(56) References Cited

U.S. PATENT DOCUMENTS 5,955,874 A * 9/1999 Zhou et al. ..... 323/315
6,107,866 A * 8/2000 Migliavacca ..... 327/539
6,204,724 B1 * 3/2001 Kobatake ..... 327/541
6,348,835 B1 * 2/2002 Sato et al. ..... 327/543
6,437,614 B1 * 8/2002 Chen ..... 327/143
6,465,997 B1 * 10/2002 Kussener ..... 323/313
6,489,831 B1 * 12/2002 Matranga et al. ..... 327/512
6,528,978 B1 * 3/2003 Lim ..... 323/313
6,727,744 B1 * 4/2004 Nagaya ..... 327/540
6,783,274 B1 * 8/2004 Umeyama et al. ..... 374/178
6,879,141 B1 * 4/2005 Ho ..... 323/315

* cited by examiner

*Primary Examiner*—Jeffrey Zweizig
(74) *Attorney, Agent, or Firm*—Baker & McKenzie LLP

(57) ABSTRACT

Disclosed herein is a reference voltage generator circuit for providing and regulating a reference voltage. In one embodiment, the generator circuit includes a first subcircuit configured to provide a bias current based on a supply voltage, where the bias current varies based on at least one performance characteristic of components comprised in the first subcircuit. The circuit also includes a second subcircuit coupled to the first subcircuit and the supply voltage. In this embodiment, the second subcircuit includes first components configured to generate a bias voltage based on and proportional to the bias current, and second components having the at least one performance characteristic. In addition, the second components in such an embodiment are configured to generate a compensation voltage based on the bias voltage that varies inversely to variations in the bias voltage to compensate for the variations in the bias voltage. Furthermore, the second circuit is further configured to generate the reference voltage based on the bias voltage and the compensation voltage. Also disclosed is a method of manufacturing a reference voltage generator circuit for providing and regulating a reference voltage.

30 Claims, 3 Drawing Sheets

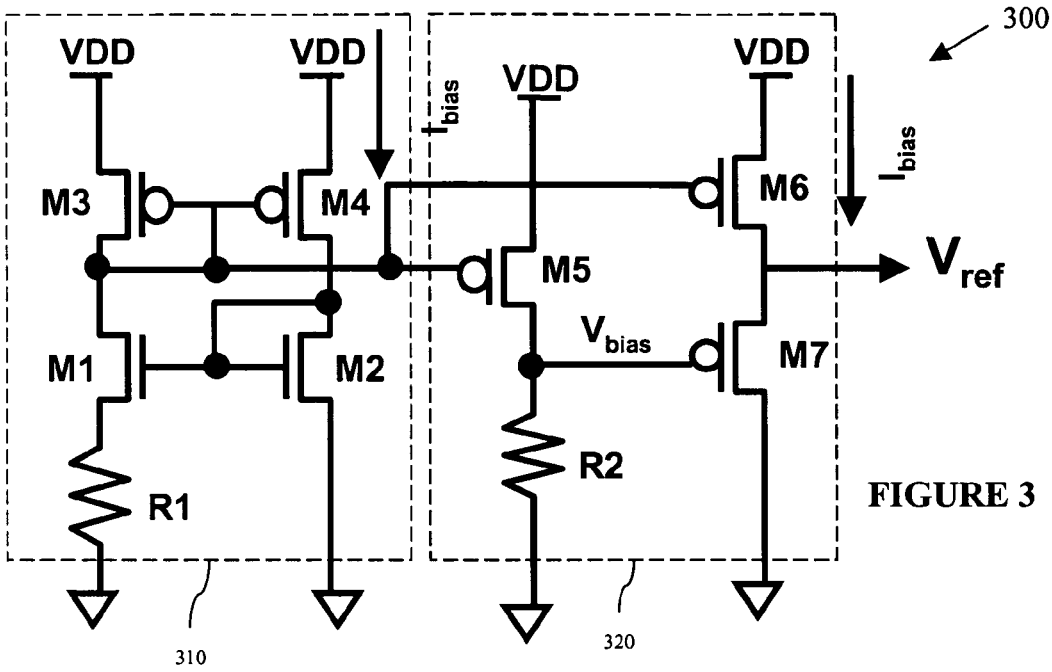
FIGURE 3
FIGURE 4
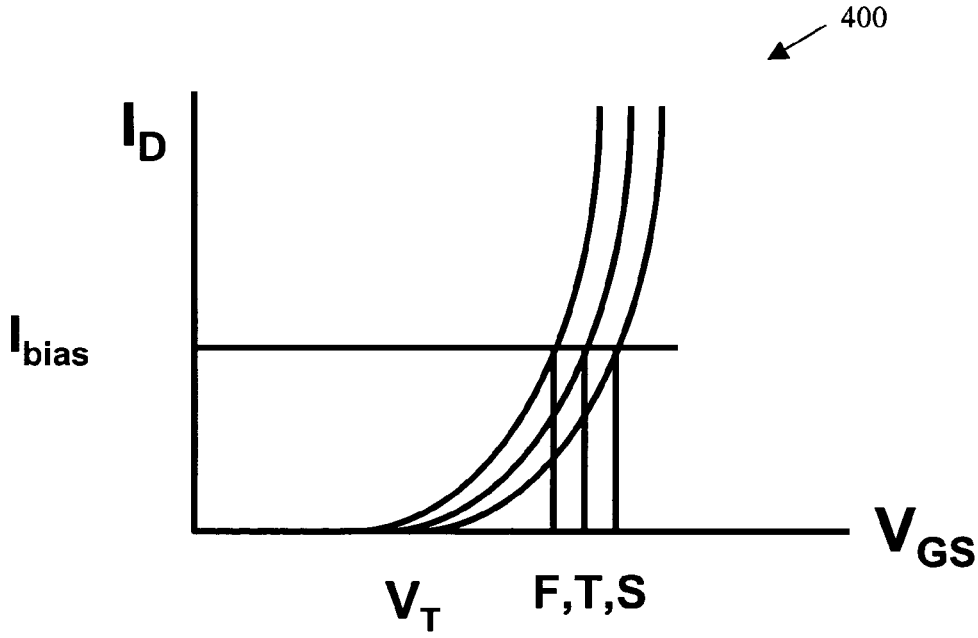

500

600

REFERENCE VOLTAGE GENERATOR CIRCUIT HAVING TEMPERATURE AND PROCESS VARIATION COMPENSATION AND METHOD OF MANUFACTURING SAME

TECHNICAL FIELD

Disclosed embodiments herein relate generally to generating substantially constant reference voltage signals for use in electrical circuits, and more particularly to a reference voltage generator circuit having temperature and process variation compensation, as well as related methods of manufacturing such a circuit.

BACKGROUND

In recent years, there continues to be dramatic density increases in integrated circuit technology for semiconductor chips. For example, the minimum feature size of lithography, such as the size of MOSFETs, has presently been reduced to one micrometer and below. Many applications implemented on modern semiconductor integrated circuit (IC) chips require accurate voltages, which becomes increasingly difficult to provide as chip density continues to increase. To provide these accurate, regulated voltages, precise and constant reference voltage signals must be generated and maintained during circuit operation.

Making the task of generating constant reference voltages more difficult are several on-chip and environmental effects that consistently counteract the regulation of on-chip voltages. Examples include temperature effects and manufacturing process variations with the structures of the components creating the reference voltage generator circuit. Relatively extreme variations in temperature, for example, the operating temperature of active devices within the generator circuit, often affect the resistance, capacitance, and voltage, and thus the current flow, of on-chip components, which affects the operation of the IC chip itself. More specifically, such process variations typically affect line spacings and the thickness of oxides, metals, and other layers of the semiconductor wafer, which consequently can affect on-chip voltages.

Initial approaches to provide circuit capable of generating substantially constant reference voltages in spite of these environmental effects have included the use of bipolar junction transistors (BJTs). While such BJT circuits typically provide adequate compensation for temperature-based circuit variations, they do so at the expense of large current draws (due to operation in the active region), as well as occupying large areas of valuable chip real estate. Other conventional approaches have been made using MOS components operated in the weak inversion state to obtain a stable PTAT voltage. One example is found in the paper entitled, "Optimal Curvature—Compensated BiCMOS Bandgap reference" by Popa and Mitrea. However, the current level of the MOS transistor in the weak inversion state is too low to get a stable reference voltage in the environment like a high density DRAM where a large internal noise is induced during operation. In addition, the MOS model in the weak inversion mode is typically not advantageously used safely in such a circuit design.

Other conventional approaches have operated the MOS components in active mode operation, in order to overcome the drawbacks of the weak inversion component operation. An example may be found in the paper entitled, "A Precision CMOS Voltage Reference with Enhanced Stability for the Application to Advanced VLSI's" by Yoo, et al. Unfortunately, while such an active mode operation approach does often offer a stable reference voltage in spite of temperature fluctuations, this approach does not seem to solve stability problems associated with process variations of the MOS components themselves. Accordingly, a more advantageous reference voltage generating circuit is desired.

BRIEF SUMMARY

Disclosed herein is a reference voltage generator circuit for providing and regulating a reference voltage. In one embodiment, the generator circuit includes a first subcircuit configured to provide a bias current based on a supply voltage, where the bias current varies based on at least one performance characteristic of components comprised in the first subcircuit. The circuit also includes a second subcircuit coupled to the first subcircuit and the supply voltage. In this embodiment, the second subcircuit includes first components configured to generate a bias voltage based on and proportional to the bias current, and second components having the at least one performance characteristic. In addition, the second components in such an embodiment are configured to generate a compensation voltage based on the bias voltage that varies inversely to variations in the bias voltage to compensate for the variations in the bias voltage. Furthermore, the second circuit is further configured to generate the reference voltage based on the bias voltage and the compensation voltage.

Also disclosed is a method of manufacturing a reference voltage generator circuit for providing and regulating a reference voltage. In one embodiment, the method includes forming a first subcircuit configured to provide a bias current based on a supply voltage, where the bias current varies based on at least one performance characteristic of components comprised in the first subcircuit. The method also includes forming a second subcircuit coupled to the first subcircuit and the supply voltage. In such an embodiment, the forming of the second subcircuit includes forming first components configured to generate a bias voltage based on and proportional to the bias current, and forming second components having the at least one performance characteristic. In this embodiment of the method, the second components are also configured to generate a compensation voltage based on the bias voltage that varies inversely to variations in the bias voltage to compensate for the variations in the bias voltage. Moreover, the second components are further configured to generate the reference voltage based on the bias voltage and the compensation voltage.

BRIEF DESCRIPTION OF THE DRAWINGS

For a more complete understanding of the principles disclosure herein, and the advantages thereof, reference is now made to the following descriptions taken in conjunction with the accompanying drawings, in which:

FIG. 3 illustrates one embodiment of a reference voltage generating circuit constructed according to the principles disclosed herein;

FIG. 4 illustrates a histogram of the bias current plotted as a function of threshold voltage and gate-source voltage for MOSFETs having affected by manufacturing process variations;

DETAILED DESCRIPTION OF PREFERRED EMBODIMENTS

Figure 1:
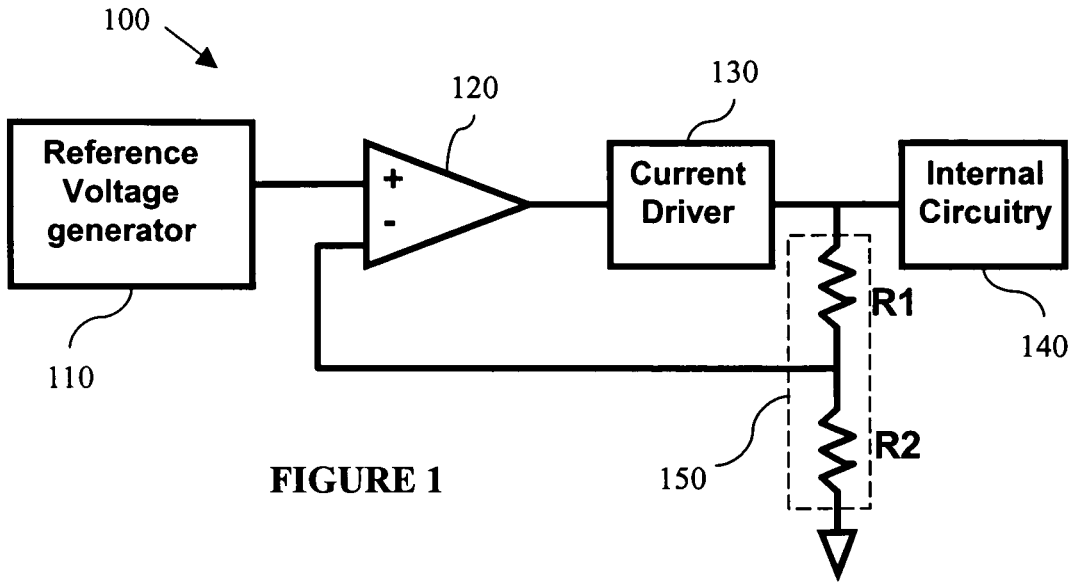
FIG. 1 illustrates a general block diagram of a typical environment for a reference voltage generator.

Referring initially to FIG. 1, illustrated is a general block diagram 100 of a typical environment for a reference voltage generator 110. As illustrated, such reference voltage generators 110 output a regulated reference voltage ($V_{REF}$) that is kept as constant as possible. The reference voltage $V_{REF}$ is kept as constant as possible since it is typically employed as an input signal to other circuits and circuit components as a basis for comparison. Such conventional reference voltage circuits 110 continue to be employed in a wide variety of applications.

In this illustrated environment 100, the reference voltage $V_{REF}$ is input for comparison to a differential amplifier 120. The output of the differential amplifier 120 is then used to drive a current driver 130 that is configured to provide current to other nearby circuitry 140. In addition, the output of the current driver 130 is also used as part of a feedback loop in the circuit. Specifically, the feedback voltage signal is taken from a voltage divider 150 formed by first and second resistors R1, R2. The feedback signal is the signal that is input to the differential amplifier 120 for comparison with the reference voltage $V_{REF}$ in order to regulate the current signal sent to the nearby circuitry 140. Since the reference voltage $V_{REF}$ is used to regulate the current signal, fluctuations in the reference voltage $V_{REF}$ must be kept to a minimum, as mentioned above.

In modern applications, the environment 100 is a voltage down converter circuit 100, where the reference voltage generator 110 is composed of a precision CMOS circuit, as are the differential amplifier 120 and the current driver 130. Since the comparison is made against the reference voltage $V_{REF}$, the overall characteristics of the down converter circuit 100 follow any significant effects on the voltage reference circuit 110 and the signal produced therefrom. Therefore, the reference voltage circuit 110 incorporating such CMOS devices, should be as insensitive to variations of the external supply voltage, operating temperature, and process variations resulting during the manufacture of the CMOS devices.

Figure 2:
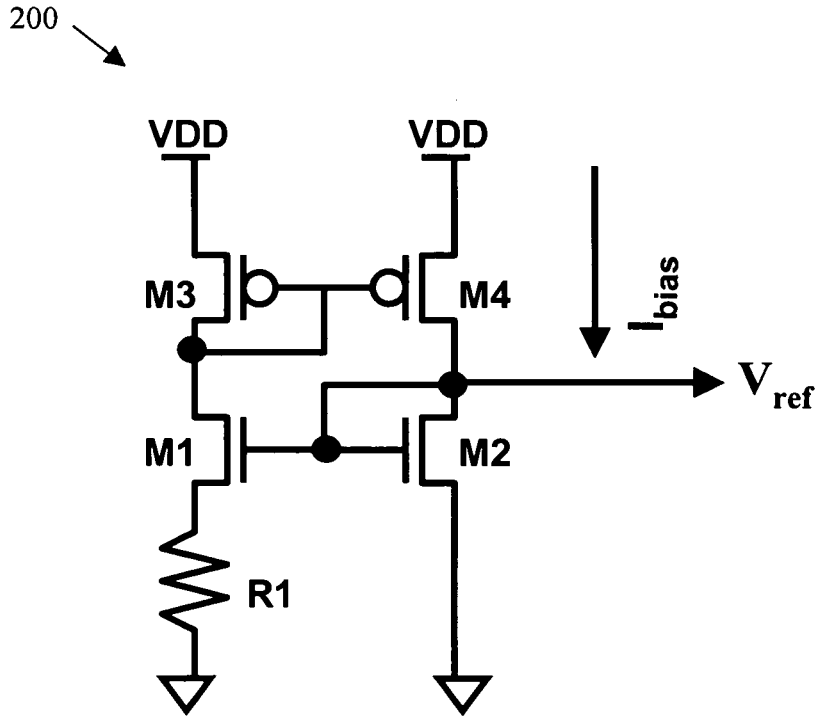
FIGURE 2 (Prior Art)
FIG. 2 illustrates a conventional circuit for generating a reference voltage signal for use, for example, in the manner described with reference to FIG. 1.

Turning now to FIG. 2, illustrated is a conventional circuit 200 for generating a reference voltage $V_{REF}$ signal for use, for example, in the manner described with respect to FIG. 1. Specifically, the circuit 200 employs semiconductor active devices M1, M2, M3, M4, e.g., CMOS transistors or general MOSFETs, in an attempt to provide a stable reference voltage $V_{REF}$ for use as described above. The use of MOS devices in VLSI, as well as other applications, provides significant benefits, such as less chip real estate and decreased bias currents, over prior BJT circuit designs.

However, as is well known, the operating characteristics of such MOS devices M1, M2, M3, M4 results in a generated bias current ($I_{bias}$) that is proportional to the absolute temperature (PTAT) of the circuit 200, and thus those devices. As a result, as temperature increases, so too does the bias current $I_{bias}$ of the circuit 200. Since the bias current $I_{bias}$ provides the basis for the reference voltage $V_{REF}$, the reference voltage $V_{REF}$ also tends to increase as the temperature increases, even when the circuit resistance (R1) remains constant. This increase is due to the typical drop in the threshold voltage ($V_T$) that is present in MOSFETs as their operating temperatures increase. As mentioned above, several approaches have been employed in an effort to combat the increase in reference voltage $V_{REF}$ due to circuit temperature, but each have disadvantages. For a detailed discussion of the effects of temperature fluctuation on reference voltage generator circuits, refer to the Yoo reference cited above, which hereby incorporated by reference for all purposes in its entirety.

One approach has been to operate the MOSFETs M1, M2, M3, M4 in the weak inversion state to obtain a stable PTAT voltage, and thus a stable reference voltage $V_{REF}$. However, the current levels of the MOSFETs M1, M2, M3, M4 when operated in the weak inversion state is typically too low to result in a stable reference voltage $V_{REF}$ in certain environment, such as a high density DRAM, where a large internal noise is commonly induced during operation. Such an approach has proven to be troublesome to implement safely in such circuit designs. Other conventional approaches have operated the MOSFETs M1, M2, M3, M4 in active mode in order to overcome the drawbacks of the weak inversion operation. Unfortunately, while an active mode operation often does provide a relatively stable reference voltage $V_{REF}$ in spite of temperature fluctuations, this approach does not address stability problems associated with process variations of the MOSFETs themselves. The circuit design disclosed herein overcomes this disadvantage.

Looking at FIG. 3, illustrated is one embodiment of a reference voltage generating circuit 300 constructed according to the principles disclosed herein. In this embodiment, the circuit 300 includes a first subcircuit 310 that is comparable to the conventional circuit 200 illustrated and described with reference to FIG. 2. As such, the first subcircuit 310 includes MOSFETs M1–M4, as well as a first resistor R1 coupled to the drain of M3. The sources of M3 and M4 are coupled to a supply voltage $V_{DD}$, while their gates are coupled together. Also as before, the gate and drain of M3 is coupled to M1, while the drain of M4 is coupled to the source and gate of M2. Finally, the drain of M1 is coupled to ground via resistor R1, while the drain of M2 is coupled directly to ground.

However, instead of tapping between M2 and M4 to get the reference voltage $V_{REF}$, as in the prior circuit 200, the current at the drain of M3 is mirrored to a second subcircuit 320 by a fifth MOSFET M5. Specifically, this tapped current is input to the gates of the fifth MOSFET M5, as well as a sixth MOSFET M6. The sources of both M5 and M6 are coupled to the supply voltage $V_{DD}$, and the drain of M5 is coupled to ground through a second resistor R2 and to the gate of a seventh MOSFET M7. The drain of M6 is coupled to the source of M7 so that M6 biases M7 based on the voltage received at the gate of M6 from the first subcircuit 310, as well as the supply voltage $V_{DD}$. The drain of M7 is then coupled directly to ground. With these electrical interconnections, the reference voltage $V_{REF}$ is now tapped between the drain of M6 and the source of M7.

As the current from the first subcircuit 310 is mirrored by M5, the resistance provided by R2 allows a bias voltage to be selected at the drain of M5, which is then input to the gate of M7, in accordance with the principles of this disclosure. In the conventional circuit 200 (i.e., subcircuit 310), R1 typically has a negative temperature coefficient, and as a result its resistance decreases as temperature increases, thus allowing the bias current $I_{bias}$ to be PTAT. Since the bias current $I_{bias}$ increases as temperature increases, the bias voltage $V_{bias}$ tapped at the drain of M5 also is now PTAT and increases with the increase in temperature (V=I*R). Moreover, the resistance of the second resistor R2 may be selected to provide a specific bias voltage $V_{bias}$ through M5. Optionally, R2 may also be constructed with a positive temperature coefficient (i.e., its resistance increases with increasing temperature) to assist in/provide a more significant positive temperature coefficient for Vbias to compensate for the variation in threshold voltage $V_T$ as temperature changes. This is the case because:

$$V_{bias}=I_{bias}*R2, \quad (1)$$

and then:

$$\Delta V_{bias}/\Delta T=\Delta I_{bias}/\Delta T*R2+I_{bias}*\Delta R2/\Delta T. \quad (2)$$

Thus, the temperature coefficient of $V_{bias}$ or $\Delta V_{bias}/\Delta T$ may be restrictedly fine-tuned. For example, if a smaller $\Delta V_{bias}/\Delta T$ is desired, r2 may be selected with a negative or low temperature coefficient. Conversely, if a larger $\Delta V_{bias}/\Delta T$ is desired, then R2 may be selected with a positive temperature coefficient.

In order to compensate for the increase in the bias voltage $V_{bias}$ when temperature increases (PTAT), the second subcircuit 320 recognizes and employs the characteristic that the threshold voltage $V_T$ of a MOSFET decreases as its temperature increases. Also, when a MOSFET, such as M7, is operated at saturation, its gate-source voltage VGS is substantially equal to its threshold voltage $V_T$. Consequently, when the temperature at M7 increases, its gate-source voltage $V_{GS}$ begins to decrease, along with its threshold voltage $V_T$. Moreover, when operated at saturation, the voltage across a MOSFET is equal to the sum of the voltage across its gate ($V_{bias}$) and its gate-source voltage $V_{GS}$. Therefore, for MOSFET M7, the reference voltage $V_{REF}$ may be determined by employing equation (3):

$$V_{REF}=V_{bias}+V_{GS(M7)} \quad (3)$$

where $V_{GS}$(M7) is the gate-source voltage of MOSFET M7. As a result and in accordance with the disclosed principles, in circuit 300, as the bias current $I_{bias}$ increases with an increase in temperature, the bias voltage $V_{bias}$ applied to the gate of M7 also increases. However, with this same increase in temperature, the threshold voltage $V_T$, and thus the gate-source voltage $V_{GS}$, of M7 correspondingly decrease with the increase in bias voltage $V_{bias}$. Thus, an offset is created that compensates for increases in $V_{bias}$ caused by conduction changes in the MOSFETs (M1–M7) due to temperature variations. By employing equation (1), therefore, the final reference voltage $V_{REF}$ can be maintained substantially constant in the face of any number of fluctuations based on one or more performance characteristics, such as the affects of temperature changes, of the components in the circuit 300.

Moreover, the disclosed circuit 300 also allows a substantially constant reference voltage $V_{REF}$ to be maintained in spite of process variations that are so often prevalent in the manufacture of the semiconductor components employed in voltage generator circuits. More specifically, the bias current $I_{bias}$ flowing through both subcircuits 310, 320 is somewhat sensitive to process variations occurring during the manufacture of the components used, particularly MOSFETs M3 and M4; thus, the bias voltage $V_{bias}$ is equally affected. For example, in typical situations a MOSFET with "slow corner" ("S") characteristics developed during manufacturing will exhibit a larger threshold voltage $V_T$ than the typical ("T") for that type of MOSFET. Conversely, a MOSFET with "fast corner" ("F") characteristics from manufacturing process variations will exhibit a smaller threshold voltage $V_T$ than the typical. As a result, the bias current $I_{bias}$ flowing through subcircuits 310, 320 with slow corner MOSFETs (higher $V_T$) will be lower than the average, while the bias current $I_{bias}$ flowing through fast corner MOSFETs (lower $V_T$) will be higher than the average. Consequently, the bias voltage $V_{bias}$, and thus the gate-source voltage $V_{GS}$, will also be affected, as illustrated in the histogram 400 of FIG. 4.

Fortunately, the ability of the disclosed circuit 300 to provide a substantially constant reference voltage $V_{REF}$ extends to situations where process variations, rather than only temperature variations, result in reference voltage $V_{REF}$ fluctuations. Specifically, since MOSFETs M5–M7 are typically manufactured at the same time as the MOSFETs found in the first subcircuit 310, and typically using the same manufacturing processes, similar process variations are more likely to be consistent across all the MOSFETs M1–M7. Since MOSFETs M5–M7 are coupled in such a way to provide a compensating (e.g., inverse) affect on the reference voltage $V_{REF}$ (i.e., a decreasing VGS to compensate for an increasing $V_{bias}$ when temperature increases), a similar compensating affect based on process variations is provided. For example, if "fast corner" process variations are present in MOSFETs M1–M4, conventional CMOS/MOSFET circuits do not provide any compensation for this characteristic. In contrast, if such "fast corner" process variations are present in MOSFETs M1–M4 of circuit 300, the same "fast corner" characteristics will likely be present in MOSFETs M5–M7, but the inversely proportional reaction of M5–M7 in the face of the same or similar process variations (i.e., all the components have the same or similar performance characteristics), will compensate for the negative effects the "fast corner" characteristics have on the bias current $I_{bias}$. These are also illustrated in the histogram 400 of FIG. 4.

Figure 5:
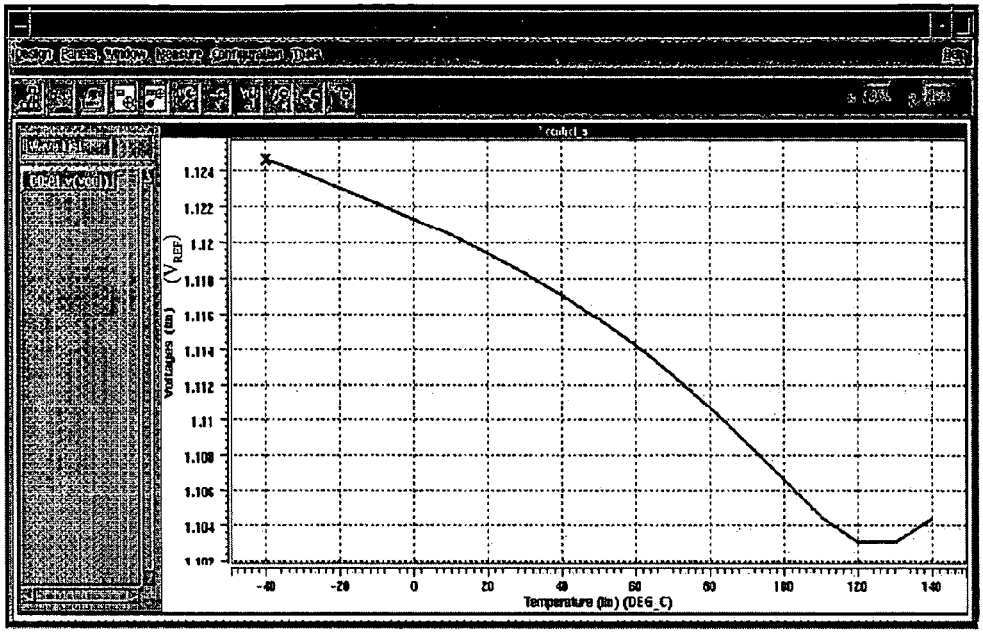
FIG. 5 illustrates a screen shot of an actual reference voltage simulation based on a circuit constructed as disclosed herein across a large temperature fluctuation.

Referring now to FIG. 5, illustrated is a screen shot 500 of an actual reference voltage $V_{REF}$ simulation based on a circuit constructed as disclosed herein across a large temperature fluctuation. As illustrated, the operating temperature of the circuit fluctuated from about −40° C. to about 140° C. However, even during this large variation in temperature, the plot demonstrates that a circuit constructed according to the disclosed principles had a reference voltage $V_{REF}$ that fluctuated only by about 20 mV, from about 1.124 V to about 1.103 V. In addition, it should be noted that these results were obtained from a circuit having MOSFETs constructed using conventional processing techniques and standards (typically having process variations as discussed above), and yet only the 20 mV variation in the reference voltage $V_{REF}$ was detected.

Figure 6:
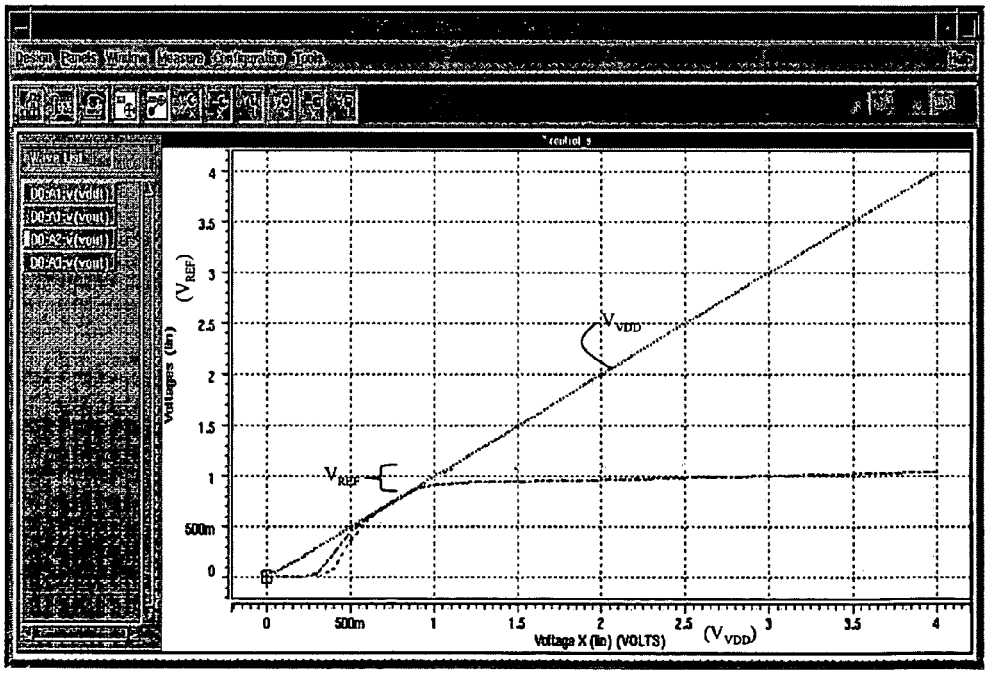
FIG. 6 illustrates another screen shot of an actual reference voltage simulation based on a circuit constructed as disclosed herein taken across a large variation in supply voltage for the circuit.

Turning finally to FIG. 6, illustrated is another screen shot 600 of an actual reference voltage $V_{REF}$ simulation based on a circuit constructed as disclosed herein, this time taken across a large variation in supply voltage $V_{DD}$ for the circuit. In this illustration, the supply voltage $V_{DD}$ is increased from 0 V to about 4 V. Across this voltage escalation, the reference voltage $V_{REF}$ is shown increasing from 0 V to a desired constant amount, which is about 1.1 V in this embodiment. However, even during this large variation in supply voltage $V_{DD}$, the plot demonstrates that once the reference voltage $V_{REF}$ reaches its intended level, the circuit constructed according to the disclosed principles is capable of regulating the reference voltage $V_{REF}$ within about 50 mV. Those who are skilled in the pertinent field of art will realize that such a range results in a substantially constant reference voltage $V_{REF}$. Again, it should be noted that these results were obtained from a circuit having MOSFETs constructed using conventional processing techniques and standards (typically having process variations as discussed above), yet only a 50 mV/V variation in the reference voltage $V_{REF}$ was detected.

As may be determined from the above descriptions and accompanying figures, a circuit design, constructed and implemented in accordance with the principles disclosed herein, provides significant advantages over conventional circuits. For example, as discussed in detail above, the disclosed approach provides for not only temperature fluctuation compensation when regulating the reference voltage, but also for structural variations resulting from the manufacturing processes used to construct the MOS devices in the generating circuit. For example, a voltage dependence of only about 50 mV per each volt of the supply/applied voltage in three process "corners" is also provided, thus providing a substantially supply voltage independent generator. Likewise, only about a 100 ppm/° C. temperature coefficient is present when an external supply voltage ($V_{ext}$) (e.g., a voltage to be down-converted) is about 2.5V. Both of these results are comparable with the band-gap reference voltage provided in conventional reference voltage generating circuits employing BJTs. However, the larger chip real estate and the large current draw of a BJT circuit is replaced by a typical <10 uA bias current using the disclosed approach.

Additionally, the 50 mV/V stability provided in spite of supply voltage fluctuations also translates into only about a 70 mV fluctuation in the face of resistor R1 variations up to about +/−20% of resistance. In addition, the disclosed technique may be used at the sub-micron processing level, for example in a 0.13 process. Moreover, where early conventional approaches required operating the MOSFETs in a weak inversion mode that is ill-suited for providing a stable reference voltage in certain applications, the disclosed approach allows operation of the MOSFETs at saturation, which results in a strong and stable voltage output. Furthermore, use of a generating circuit in accordance with the disclosed approach provides the ability to generate tunable reference voltage levels by tuning R1 and the R2/R1 ratio as long as M5~M7 are operating in the saturation region. This is the case because:

$$V_{ref} = V_{bias} + V_{GS}(M7) \quad (4)$$

$$= I_{bias} * R2 + V_{GS}(M7) \quad (5)$$

$$= [V_{GS}(M2) - V_{GS}(M1)] * R2/R1 + V_{GS}(M7), \quad (6)$$

where:

$$Ibias = [V_{GS}(M2) - V_{GS}(M1)]/R1. \quad (7)$$

As mentioned above, R1 determines the $I_{bias}$ and $V_{GS}$(M7), while the ratio of R2/R1 determines $V_{bias}$. The reference voltage $V_{ref}$ may be tuned in the range from $V_{sat}$(M7) (the smallest $V_{DS}$ needed to make M7 saturated) to $V_{ext}$−$V_{sat}$ (M6) (the smallest $V_{DS}$ to make M6 saturated). Finally, while the various MOSFETs M1–M7 disclosed in the circuit shown in FIG. 3 are shown as either PMOS or NMOS devices, it is envisioned that those who are skilled in the field of art may substitute one or more of the components without varying from the broad scope of this disclosure.

While various embodiments of reference voltage generator circuits, and methods for generating and regulating reference voltages, according to the principles disclosed herein have been described above, it should be understood that they have been presented by way of example only, and not limitation. Thus, the breadth and scope of the invention (s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A reference voltage generator circuit for providing and regulating a reference voltage, the generator circuit comprising:

a first subcircuit configured to provide a bias current based on a supply voltage, the bias current varying based on at least one performance characteristic of components comprised in the first subcircuit; and a second subcircuit coupled to the first subeircuit and the supply voltage, the second subeircuit comprising:

at least one first component configured to generate a bias voltage based on and directly proportional to the bias current, and at least one second component having the at least one performance characteristic and configured to generate a compensation voltage based on the bias voltage that varies inversely to variations in the bias voltage, due to the at least performance characteristic of the at least one second component, to compensate for the variations in the bias voltage, and further configured to generate the reference voltage based on the bias voltage and the compensation voltage.

2. A reference voltage generator circuit according to claim 1, wherein the at least one performance characteristic comprises a variation in corresponding outputs of the components comprised in the first and second subcircuits based on changes in an absolute temperature of the generator circuit or on structural characteristics resulting from tolerances in related manufacturing processes employed to construct the first and second components.

3. A reference voltage generator circuit according to claim 2, wherein the bias voltage varies proportionally to the absolute temperature of the generator circuit, and the compensation voltage varies inversely proportional to the absolute temperature.

4. A reference voltage generator circuit according to claim 2, wherein the variations in outputs of the second components vary inversely to the variations in outputs of the components comprised in the first subcircuit and the at least one first component of the second subcircuit.

5. A reference voltage generator circuit according to claim 1, the second subcircuit comprising a compensation transistor configured to generate the compensation voltage based on the bias voltage, a source of the compensation transistor coupled to the supply voltage and a gate of the compensation transistor receiving the bias voltage.

6. A reference voltage generator circuit according to claim 5, wherein the compensation transistor comprises a threshold voltage affected by the at least one performance characteristic.

7. A reference voltage generator circuit according to claim 6, wherein the compensation voltage comprises a gate-source voltage across the transistor tbat is proportional to the threshold voltage.

8. A reference voltage generator circuit according to claim 7, wherein the compensation transistor comprises a metal-oxide-semiconductor field-effect transistor.

9. A reference voltage generator circuit according to claim 8, wherein the compensation transistor is configured to be operated at a saturation level.

10. A reference voltage generator circuit according to claim 7, wherein the second subcircuit further comprises a mirror transistor configured to minor the bias current from the first subcircuit, and a resistive element coupled to an output of the mirror transistor and having a voltage drop thereacross providing the bias voltage.

11. A reference voltage generator circuit according to claim 10, wherein the resistive element comprises a positive temperature coefficient.

12. A reference voltage generator circuit according to claim 10, wherein the first subcircuit comprises a plurality of current source transistors configured to generate the bias current.

13. A reference voltage generator circuit according to claim 12, wherein the plurality of current source transistors comprises a plurality of metal-oxide-semiconductor field-effect current source transistors.

14. A reference voltage generator circuit according to claim 12, wherein the first subcircuit further comprises a resistive element having a negative temperature coefficient coupled to a drain of at least one of the plurality of current source transistors.

15. A reference voltage generator circuit according to claim 1, wherein the at least one performance characteristic of components comprised in the first subcircuit is the same as the at least one performance characteristics of the at least one second component in the second subcircuit.

16. A method of manufacturing a reference voltage generator circuit for providing and regulating a reference voltage, the method comprising:

forming a first subcircuit configured to provide a bias current based on a supply voltage, the bias current varying based on at least one performance characteristic of components comprised in the first subcircuit; and forming a second subcircuit coupled to the first subcircuit and the supply voltage, the forming of the second subcircuit comprising:

forming at least one first component configured to generate a bias voltage based on and proportional to the bias current, and forming at least one second component having the at least one performance characteristic and configured to generate a compensation voltage based on the bias voltage that varies inversely to variations in the bias voltage, due to the at least performance characteristic of the at least one second component, to compensate for the variations in the bias voltage, and further configured to generate the reference voltage based on the bias voltage and the compensation voltage.

17. A method according to claim 16, wherein the at least one performance characteristic comprises a variation in corresponding outputs of the components comprised in the first and second subcircuits based on changes in an absolute temperature of the generator circuit or on structural characteristics resulting from tolerances in related manufacturing processes employed to construct the first and second components.

18. A method according to claim 17, wherein the bias voltage varies proportionally to the absolute temperature of the generator circuit, and the compensation voltage varies inversely proportional to the absolute temperature.

19. A method according to claim 17, wherein the variations in outputs of the second components vary inversely to the variations in outputs of the components comprised in the first subcircuit and the at least one first component of the second subcircuit.

20. A method according to claim 17, wherein forming a second subcircuit further comprises forming a compensation transistor configured to generate the compensation voltage based on the bias voltage, a source of the compensation transistor coupled to the supply voltage and a gate of the compensation transistor receiving the bias voltage.

21. A method according to claim 20, wherein the compensation transistor comprises a threshold voltage affected by the at least one perfonnance characteristic.

22. A method according to claim 21, wherein the compensation voltage comprises a gate-source voltage across the transistor that is proportional to the threshold voltage.

23. A method according to claim 22, wherein the compensation transistor comprises a metal-oxide-semiconductor field-effect transistor.

24. A method according to claim 23, wherein the compensation transistor is configured to be operated at a saturation level.

25. A method according to claim 22, forming the second subcircuit further comprises forming a minor transistor configured to minor the bias current from the first subcircuit, and forming a resistive element coupled to an output of the mirror transistor and having a voltage drop thereacross providing the bias voltage.

26. A method according to claim 25, wherein the resistive element comprises a positive temperature coefficient.

27. A method according to claim 25, wherein forming the first subcircuit comprises forming a plurality of current source transistors configured to generate the bias current.

28. A method according to claim 27, wherein the plurality of current source transistors comprises a plurality of metal-oxide-semiconductor field-effect current source transistors.

29. A method according to claim 27, wherein forming the first subcircuit further comprises forming a resistive element having a negative temperature coefficient and coupled to a drain of at least one of the plurality of current source transistors.

30. A method according to claim 16, wherein the at least one performance characteristic of components comprised in the first subcircuit is the same as the at least one performance characteristics of the at least second component in the second subcircuit.

* * * * *